United States Patent [19]

Eggemar

[11] Patent Number: 4,703,597

[45] Date of Patent: Nov. 3, 1987

[54] ARENA FLOOR AND FLOORING ELEMENT

[76] Inventor: Bengt V. Eggemar, Torparmors väg 6, S-162 45 Vällingby, Sweden

[21] Appl. No.: 877,935

[22] Filed: Jun. 24, 1986

[30] Foreign Application Priority Data

Jun. 28, 1985 [EP] European Pat. Off. ..... 85108012.7

[51] Int. Cl.[4] ..... E04B 5/48

[52] U.S. Cl. ..... 52/220; 52/588; 62/235; 165/168; 165/171

[58] Field of Search ..... 52/220, 403, 480, 588; 62/235; 165/168, 171

[56] References Cited

U.S. PATENT DOCUMENTS

| | | | |
|---|---|---|---|
| 2,559,198 | 7/1951 | Ogden | 52/220 X |
| 3,301,319 | 1/1967 | Messill | 165/171 X |
| 3,555,762 | 1/1971 | Costanzo, Jr. | 52/588 |
| 3,621,671 | 11/1971 | Ullrich | 62/235 |
| 3,679,531 | 7/1972 | Wienand et al. | 52/588 X |
| 4,135,575 | 1/1979 | Gersch | 165/171 |

FOREIGN PATENT DOCUMENTS

| | | |
|---|---|---|
| 3100386 | 8/1982 | Fed. Rep. of Germany . |
| 2038080 | 1/1971 | France . |
| 2126106 | 3/1984 | United Kingdom . |

*Primary Examiner*—Carl D. Friedman

*Attorney, Agent, or Firm*—Sughrue, Mion, Zinn, Macpeak and Seas

[57] ABSTRACT

An arena floor useful alternately as a support for a slab of artificially frozen ice, and, when free from ice, as a deck suitable e.g. for practicing gymnastics and various games, is composed of a plurality of elongate elements held together in side by side relationship on top of a flat supporting bed. The elongate elements, which somewhat resemble matched boards and add only a few centimeters at most to the height of the bed, are formed by extrusion in desired lengths from plastic and have selected cross sectional shapes including passages permitting the circulation longitudinally through the elements of a temperature controlling fluid. By suitably selecting the plastic used in extruding said board-like elements the resiliency and hardness thereof, and hence of the floor as a whole, may be varied to fit different kinds of activities.

7 Claims, 5 Drawing Figures

ARENA FLOOR AND FLOORING ELEMENT

BACKGROUND OF THE INVENTION

1. Field of the Invention

This invention relates to an arena floor useful alternately as a support for artificially frozen ice and as a deck suitable for various activities to be practiced without the presence of ice, such as gymnastics and various games, said floor being composed of a plurality of elongate board-like elements placed and held together in parallel side by side relationship on a supporting bed. In said floor each of said elements has a width which is several times greater than the height thereof and presents a plurality of laterally spaced and longitudinally extending passages for enabling circulation of a temperature-controlling fluid therethrough. Furthermore the invention relates to an elongate element suitable for use in composing such an arena floor, said element being made of extruded plastic, i.e. a synthetic resin material, and comprising a substantially solid and panel-like upper body portion forming a generally flat element top surface, and integral therewith a lower body portion forming bottom and side wall members of the element passages.

2. Description of the Prior Art

For decades it has been known to provide, outdoors as well as indoors, artificially frozen ice rinks for skating and for practicing various ice games, such as hockey, curling and the like, Basically this is accomplished by circulating a frigid fluid, such as a brine or a glycol-water mixture, cooled by some sort of heat pump unit, through a more or less complex system of pipes spread out over the area selected for being iced and by watering said area in a manner to build up an ice slab thereon. Usually the average temperature of the fluid passed through the pipe system is then kept between about 8° C. and 12° C. below zero.

After some time of use the top layer of such an ice slab will become worn and uneven and hence in need of restoration. At least as far as large-sized rinks are concerned this is commonly carried out by means of fairly heavy, wheeled and self-propelled ice-restoring machines which are adapted to plane the top of the ice slab and to distribute a small amount of water thereover which when frozen will form a fresh and at least substantially dentfree top layer on the ice slab.

In order to assure maximum operating economy of an ice rink of the kind referred to it is advisable to support the ice slab on a bed which has a fairly high heat insulating capacity so that cooling of the sub-structure, e.g. the ground, is minimized or at least reduced. Also, for best operating economy, it has been found desirable to limit the thickness of the ice slab to about 5 centimeters or even less. However, with such a moderate thickness the ice slab will have an objectionable tendency to crack, especially under the loads of the heavy and moving ice-restoring machines, unless the floor and the bed is firm enough to resist any substantial local yielding.

For this reason it has been common practice either to embed the pipes for the circulating cooling fluid in grooves provided in a hard top layer of the bed, or to simply place the pipes directly on top of a hard bed surface so that they will instead be embedded in the ice itself. Some suggestions have also been made that the pipes or passages for the cooling fluid should be combined with rigid metal panels which when held together in edge to edge relationship can form a complete and hard deck on top of the bed. However, practice has proved that the installation of such a deck is very difficult because, for various obvious reasons, the metal panels can only be given fairly moderate dimensions, and hence a tremendous number of fluid couplings is needed to fit them together. Also each such coupling represents a leakage hazard if not very carefully made.

Now, in many cases ice rinks are needed only during certain seasons or even shorter periods, and it is then desirable to use the area occupied by the ice for various other activities in between. Since ice rinks are most frequently arranged within sport grounds or halls, it is most likely that such other activities will be gymnastics and various ball games which do not only require a fairly flat and smooth floor but should preferably be practiced on a surface which is at least slightly elastic and yielding. Accordingly, in case the bed for the ice has the fluid pipes embedded in grooves it will at least be necessary to cover it with a separate, fairly thick mat, which must be removed before the area is again iced, and in case the fluid pipes are placed on top of the bed these pipes must first be removed before a suitable mat can be spread out and the again be properly distributed over the area after removal of the mat before the bed can again be used for supporting a layer of ice. Also when prefabricated metal panels of the kind referred to above are used it will at least be necessary to place a suitable mat on top of them.

Considering that most ice rinks have areas exceeding more than one thousand square meters, it will be obvious that the work needed to change each of them into an arena suitable for gymnastic or other activities requiring a relatively soft floor surface will be tremendous even with the most convenient forms of the prior art structures so far used. In addition, considerable space will be needed for storing the mats, or the pipe system, temporarily to be removed.

Accordingly, there is an obvious need for an improved arena floor which can be permanently installed on top of a firm, heat-insulating bed and alternately serve as a practically non-yielding support for artificially frozen ice produced by circulating a cooled fluid through passages formed in the floor itself and, after removal of the ice only, as a more or less elastically yielding deck, the softness of which may even, if so needed or desired, be adjusted by instead circulating a warm fluid through said passages, it being understood that such a warm fluid may also assist in rapidly melting away the ice.

SUMMARY OF THE INVENTION

The aim of the present invention is to provide such an improved arena floor which also satisfies practical demands as far as easy manufacture and installation are concerned.

The idea behind this invention is primarily based on the knowledge that during the last decades there have come forth various plastics, i.e. materials based on synthetic resins or polymers with or without the addition of elasticizers, plasticizers and fillers, which not only are well suited for being extruded but also have the valuable property of changing their hardness with temperature, and that the compositions of such plastics may readily be adjusted to make the materials exhibit within a temperature range above about +10° C. somewhat elastic properties corresponding to a hardness less than about 75 Shore A, and at a temperature below about −5° C. a considerably higher hardness of say about 90 Shore A, which from a practical point of view is apprehended as being about the same rigidity as that of ordinary softwoods. By using such plastics for extruding board-like flooring elements of any lengths needed, and by carefully designing the cross sectional configuration of these elements in a manner to achieve an optimum utilization of the features of the material, it has been found possible to solve the problems referred to hereinbefore within a reasonable cost limit.

In practice, it will most frequently be satisfactory to use one and the same material throughout the entire cross section of the extruded elements, but it will also be possible by using a co-extrusion technique well known per se to use a modified plastic in certain parts thereof, such as for obtaining a somewhat tougher and more wear-resistant top surface on the elements.

For further elucidation of the invention some preferred embodiments thereof will now be more closely described with reference to the accompanying drawings.

DESCRIPTION OF THE PREFERRED EMBODIMENTS

Figure 1:
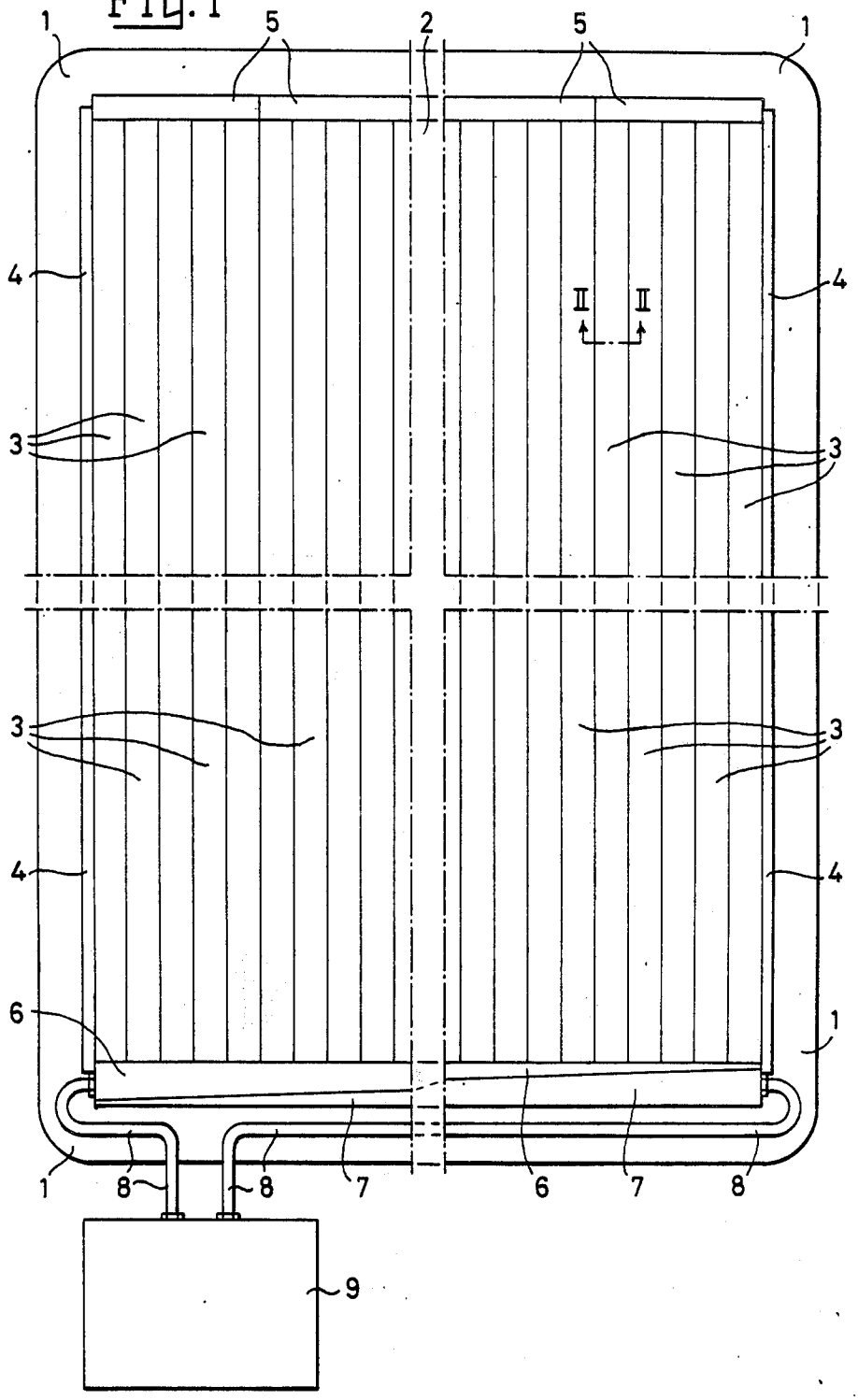
FIG. 1 is a diagrammatic top plan view of an area suitable for alternative use as an ice rink or as an ice-free arena e.g. for gymnastic or other activities, an associated heat pump equipment being also diagrammatically shown.
Figure 2:
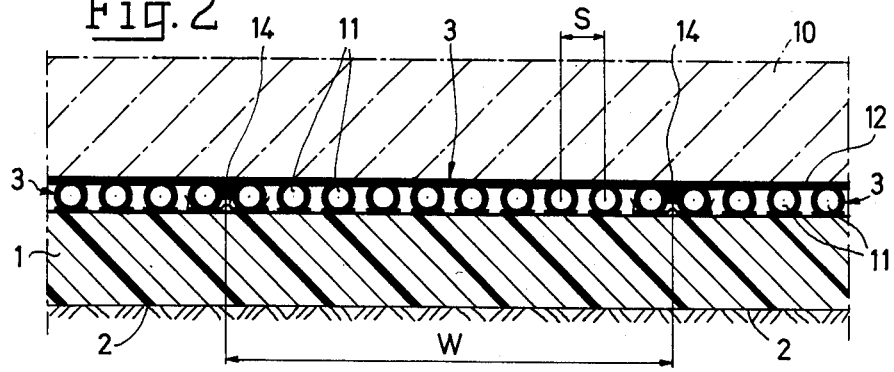
FIG. 2 is a fragmentary, enlarged vertical section of the rink or arena taken on the line II—II in FIG. 1.

In FIG. 1 an arena bed 1 is arranged on a suitable substructure 2 (see FIG. 2), such as a level ground surface or hall floor area. The bed 1 has a flat, continuous top surface on top of which a plurality of parallel, elongate flooring elements 3 are supported and held together in edge to edge relationship, such as by longitudinally extending border strips 4, in a manner to form a continuous covering or deck of any desired size. As will appear from the following, each and all of the elements 3 have a plurality of longitudinal passages extending therethrough, and one end of each element 3 is connected to a flow reverser 5 which is common to a group of elements and which puts the ends of adjacent passages in open communication with one another. The other end of each element 3 is connected to both of a pair of headers 6, 7 which in turn are individually connected by pipes 8 to a heat pump unit 9.

By means of the unit 9 a suitable fluid, such as a brine or a glycol-water mixture, may thus be circulated through the pipes 8, which may be embedded in the bed 1 if so desired, and through the flooring elements 3 rested on top of the bed. Depending on the direction of flow, which is not critical, one header, say header 6, will serve to distribute the circulating fluid to every second passage in all the elements 3, and after having passed through the elements, first towards the flow turners 5 and then back again, the various fluid flows are collected by the other header, say header 7, and returned to the unit 9. Other circulating systems, also well known per se, may be utilized if desired.

Primarily the unit 9 is adapted to supply to the circuit just described a fluid which is cool enough to make water, spread out on the deck formed by the elements 3, freeze into ice and to maintain the ice slab 10 (FIG. 2) thus formed in a satisfactory condition, which means that the surface temperature thereof should be between about 1° C. and at least 3° C. below zero. Ordinarily this requires that the fluid returning to the unit 9 after having passed through the circuit must still have a temperature of about 8°–9° C. below zero, and the capacity of the heat pump unit 9 must be selected accordingly. However, in connection with the present invention it may also be desirable, and especially preferred if the deck structure is located outdoors or in an unheated building and intended to be used in cold seasons for other activities than ice sports or games, that the unit 9 is capable of alternatively supplying to the circuit a slightly heated fluid, the temperature of which is sufficiently high to keep the elements 3 at a temperature of at least about 10° C. above zero and possibly even within a range of 15°–20° C. above zero.

The bed 1 on which the elements 3 rest should have a sufficiently high heat insulating capacity to prevent any significant amount of heat from being drawn from the substructure 2 when frigid fluid is circulated through the elements, and at the same time the compressive strength of the bed 1 must be sufficiently high to prevent local yielding, such as under the load of a heavy moving ice-restoring machine. Most commonly these combined qualities are nowadays achieved by building up the bed 1 from blocks or slabs of foamed polystyrene having closed pores and an appropriately selected density, but other heat insulating materials, if necessary combined with rigid panels, may be resorted to as is also known per se. If porous polystyrene blocks or slabs are used a bed thickness of about 30 millimeters or slightly more should be satisfactory in most cases.

The elements 3 forming the continuous covering or deck somewhat resemble ordinary floorboards, each of them having a width W of between 10 and 20 centimeters, preferably about 15 centimeters, and a total thickness or structural height H (FIGS. 3–5) not exceeding about 30 millimeters and preferably lying between 10 and 15 millimeters. Each element 3 consists of a strip-like body extruded from a thermoplastic and having a substantially uniform cross section throughout its length, which generally corresponds to the full length or width of the desired deck and thus may amount to 60 meters or even more. This is in no way a problem because at normal room temperature the elements 3 will be flexible enough to be wound up into relatively easily handled and transported coils having a fairly moderate diameter, say in the order of 1 to 1.5 meters. Obviously, the fact that the elements 3 can be made free of joints between their ends minimizes the risk of leakage and highly facilitates the installation work.

As already mentioned each element 3 has a plurality of substantially parallel fluid passages 11 entending longitudinally therethrough, and preferably these passages have a circular or at least rounded cross section. In particular when it is desirable to use the circuit illustrated in FIG. 1, where the fluid is first passed through one passage 11 to the remote end of each element 3 and then returned to the inlet end through an adjacent passage, it may be desirable to have an even number of passages 11 in each element. Furthermore, all the elements 3 have a generally flat top surface 12 which may have small and shallow longitudinally extending grooves 13 therein (FIGS. 3–5) to increase friction and improve adherence of the ice 10 formed thereon. All the fluid passages 11 extend at least approximately in a common plane, which is parallel to the top surface 12, and the lateral spacing S between adjacent fluid passages 11 should be less than three times the vertical inner dimension or inner diameter d (FIGS. 3–5) of the passages, and not exceed twice the element height H.

As already pointed out hereinbefore it is the aim of the invention to provide by means of the elements 3 a bed covering or deck which may be alternately and equally well used as a firm and practically non-yielding support for artificially frozen ice 10 and, when free from ice, as a slightly yieldable and somewhat elastic mat suitable for various other activities. Basically this is achieved by extruding the elements 3 from a thermoplastic the properties of which are so selected or adjusted that within a temperature range above about +10° C. the material will be significantly more flexible, tough and elastic than at a temperature below 0° C., and especially within a temperature range below about −5° C. the hardness of the material should be at least 95 Shore A.

Ordinarily, any supplier of extrusion materials can offer a variety of resin compositions satisfying these demands and having also a satisfactory durability and abrasion resistance. Of course, the material chosen must also be compatible with the fluid used in the heat transferring circuit. In pilot tests, certain polyvinyl as well as polypropylene resin compositions have been successfully used.

Figure 3:
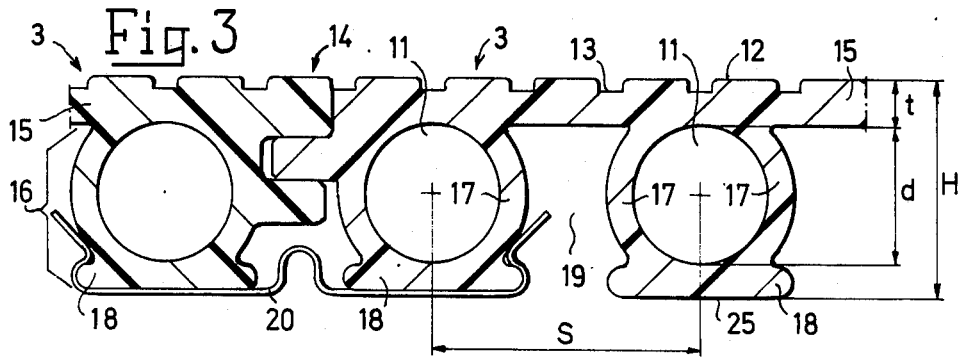
FIG. 3 is a further enlarged, fragmentary cross sectional elevation of a typical extruded flooring element for use in providing an arena floor as depicted in FIG. 2.
Figure 4:
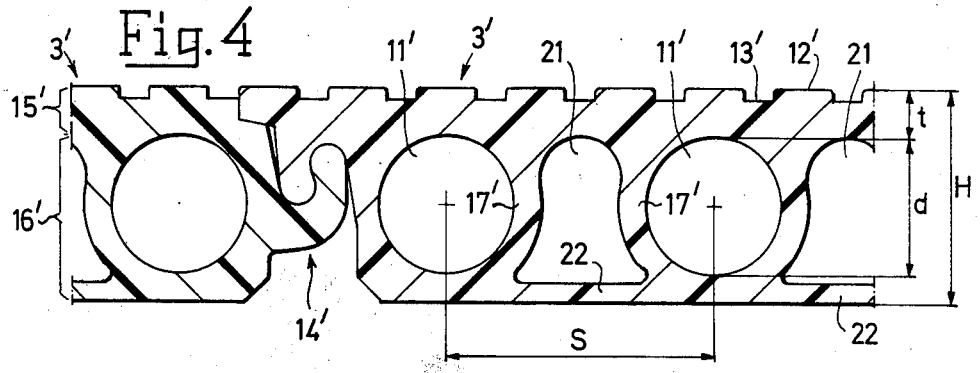
FIG. 4 is a similar fragmentary cross sectional elevation of a modified variant of the extruded flooring element.
Figure 5:
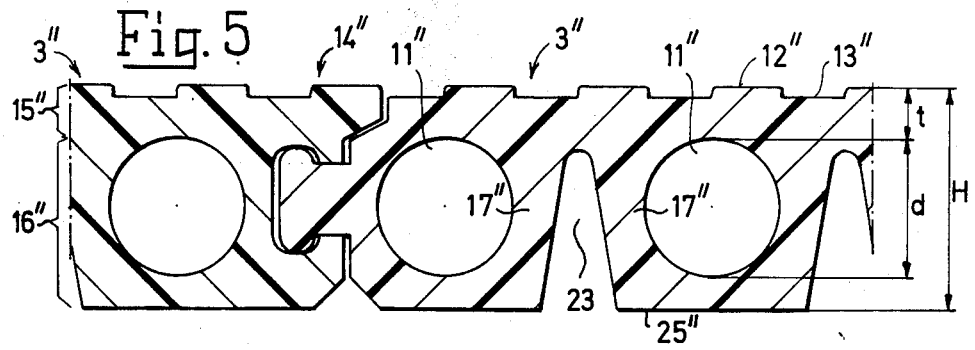
FIG. 5 is a fragmentary cross sectional elevation similar to the one in FIG. 3 but showing a further modified variant of the extruded flooring element.

Further, it has been found that the cross sectional configuration of the elements 3, which is of course identical in all the elements of a certain covering or deck, should be carefully selected in order to bring forth the desired properties when the deck is to be used without ice e.g. for gymnastic activities, in which case a fairly soft floor is preferred, or for various games such as tennis, basketball or the like, in which case a slightly harder floor is most frequently desired. FIGS. 3, 4 and 5 show some cross sectional configurations which have been found particularly suitable and also illustrate different designs of the longitudinal joints 14 between adjacent elements.

In FIG. 3 each extruded element 3 comprises an upper panel-like body portion 15, which forms the top face 12 with its shallow grooves 13, and the thickness t of which is defined by the uppermost inner wall portions of the fluid passages 11, and a lower body portion 16, which is integral with said upper body portion 15 and through which the fluid passages 11 extend. Each fluid passage 11 has its own curved side walls 17 and a foot section 18 with a bottom surface 25 forming part of the substantially planar bottom side of the element. Thus in FIG. 3 the lower body portion 16 is actually divided into a plurality of longitudinally extending ribs which are separated from one another by downwardly open channels 19. The width of the bottom surface 25 of each foot section 18 at least slightly exceeds the diameter d of the related fluid passage 11 in order to stabilize the corresponding rib in the lateral direction. The open channels 19 extend up to the lower side of the upper body section 15, and the cross section of these channels is so chosen that the passage side walls 17 will have a considerable freedom to flex laterally outwards, provided that the temperature of the element 3 is high enough to make the material of the element resiliently flexible.

The thickness t of the upper body portion 15 is shown to be between one fourth and one fifth of the total body height H, which in most cases will be sufficient to let said upper body portion act as a load distributor without too much sagging between the ribs. Further, the inner diameter d of the fluid passages 11 is almost two thirds of the body height H, and the spacing S between adjacent fluid passages 11 is about twice said inner diameter d, or in other words substantially less than twice the body height H. With a thickness of the passage side walls 17 slightly exceeding half the thickness t of the upper body portion 15 and with a total body height H of about 12 millimeters excellent pilot test results have been obtained with the proportions shown in FIG. 3.

The longitudinal joint 14 between adjacent elements 3 is in FIG. 3 shown as a kind of simple tongue and groove joint which is held together by means of longitudinally spaced apart spring clips 20 resting on the bed 1 (FIG. 2) and embracing the outermost foot sections 18 of the joined elements 3 as shown.

In FIG. 4 the cross sectional configuration of the elements 3' is generally similar to the one shown in FIG. 3 with two exceptions, namely that the channels 21 between the side walls 17' of adjacent fluid passages 11' have approximately semi-circular upper portions, whereby the passage side walls 17' become stiffened, and are closed at their bottoms by bottom wall portions 22 forming parts of a substantially planar and uninterrupted bottom face of the element. Also, in FIG. 4 the longitudinally extending joint 14' between adjacent elements 3' is designed as a kind of "hook-in-hook" joint making the use of separate clips or similar interconnecting means unnecessary.

In FIG. 5 the cross sectional configuration of the elements 31'' is modified in a manner to make the side walls 17'' of the fluid passages 11'' considerably thicker and less disposed to flex, whereby the softness of the element will be more dependent on the elastic compressability of said walls. Again the supporting ribs forming the lower body portion 16' are separated by downwardly open channels 23, but in this case the channels are approximately wedge-shaped in cross section and have a slightly reduced depth in comparison with the channels 19 in FIG. 3. As can be seen, the channel openings are sufficiently narrow in width to leave under each rib a bottom surface portion 25'' which is slightly broader than the inner diameter d of the respective fluid passage 11'' so that lateral tilting of the rib is avoided. The longitudinal joint 14'' illustrated in FIG. 5 is again a kind of tongue and groove joint but modified in a snaplock fashion and capable of permitting some play between the lateral edges of adjacent elements.

Again referring to FIG. 2 it should be understood that the upper surface of the bed 1 must be sufficiently hard to remain substantially flat under any load to which the arena floor might reasonably be subjected and hence let the stiffness of the side walls of the fluid passages 11 determine the softness of the top surface 3 of the completed floor. In other words, the bed 1 must not to any significant degree enter the downwardly open channels 19 and 23 in the flooring elements illustrated in FIGS. 3 and 5, respectively.

As will be appreciated, since the elements 3, 3', 3'' are made of a material the stiffness of which varies with the temperature of the element itself, and since this temperature mainly depends on the temperature of the fluid circulated through the passages 11, 11',11'', the resiliency of the covering or deck formed by the elements may readily be changed as desired also by positively adjusting the temperature of the circulating fluid, which, of course, is done at the heat pump unit 9 as indicated hereinbefore.

Although in most cases it will be quite satisfactory to use one and the same thermoplastic resin compound in all parts of the cross section of the elements 3, 3', 3'', there is a further possibility to adapt the features of the elements to special demands, namely by using a co-extrusion technique nowadays commonly known in the art, whereby e.g. the upper body portion 15 of the element 3 may be formed from a slightly more rigid material than the lower body portion 16 although both are extruded at the same time in a manner to form an integral body strip. In the same way the top surface layer of the upper body portion 15 may be given a higher friction coefficient or another colour than the rest of the element body.

I claim:

1. A multipurpose sports arena floor installation, comprising:

(a) a floor supporting bed (1) of heat insulating material, (b) a floor composed of a plurality of horizontally elongate, extruded floor elements (3) joined together in a parallel, side-by-side relationship on said supporting bed and each having an upper panel portion (15) defining a generally flat top surface (12) and, formed integrally therewith and on a lower side thereof, a plurality of longitudinally extending and laterally spaced fluid passages (11), each of said passages having side wall members (17) extending generally downwardly from said upper panel portion and a bottom wall member (18), (c) means (5,6,7) connecting said fluid passages of said floor elements in a manner to form a fluid circulation circuit, (d) means (8) for circulating a temperature controlling fluid through said circuit, and (e) means (9) for selectively lowering the temperature of said circulated fluid sufficiently to create an artificial ice rink on top of said floor by freezing water spread thereon, wherein:

(1) said supporting bed has a generally flat upper surface, (2) said bottom wall members of said fluid passages rest on said generally flat upper bed surface in a manner leaving said upper panel portion of each floor element supported only by said side wall members of said fluid passages, (3) the lateral center to center spacing (S) of said fluid passages of each floor element is less than twice the height (H) of the element, (4) at least said side wall members of said fluid passages are formed of a thermoplastic material exhibiting a hardness of at least about 90 Shore A at a temperature below −5° C. sufficient to support an ice surface reconditioning machine, and a hardness of at most about 75 Shore A at a temperature above +10° C., and (5) means are provided for selectively increasing the temperature of said circulated fluid to at least +10° C. to render said floor suitable for activities to be practiced directly thereon without the presence of ice and requiring a comparatively soft floor surface.

2. An arena floor installation as defined in claim 1, wherein said floor elements are entirely formed of said thermoplastic material.

3. An arena floor installation as defined in claim 1, wherein said bottom wall members of said fluid passages of each floor element have substantially flat lower surfaces (25) resting on said generally flat upper bed surface.

4. An arena floor installation as defined in claim 3, wherein said flat lower surfaces of said bottom wall members are broadened to extend laterally beyond internal widths (d) of associated fluid passages.

5. An arena floor installation as defined in claim 4, wherein opposed side wall members of adjacent fluid passages are separated by channels (19,21,23) enabling individual deformation of said side wall members when the temperature of said circulated fluid is increased.

6. An arena floor installation as defined in claim 5, wherein said channels separating adjacent fluid passage side wall members are closed at their bottoms (22) at a level substantially coinciding with that of said bottom wall members of said fluid passages.

7. An arena floor installation as defined in claim 1, wherein the height of said floor elements is less than 15 millimeters and the width thereof is at least about 10 centimeters.

* * * * *